US005868284A

United States Patent [19]

Maechling et al.

[11] Patent Number: 5,868,284

[45] Date of Patent: Feb. 9, 1999

[54] OUTLET WITH SAMPLING PORT

[75] Inventors: David M. Maechling, St. Charles, Mo.; Kurt D. Meckfessel, Woodlands, Tex.

[73] Assignee: American Railcar Industries, Inc., St. Charles, Mo.

[21] Appl. No.: 759,940

[22] Filed: Dec. 3, 1996

[51] Int. Cl.[6] ..... B67D 5/06

[52] U.S. Cl. ..... 222/185.1; 222/288; 222/502; 222/1

[58] Field of Search ..... 222/185.1, 282, 222/288, 299, 303, 476, 502

[56] References Cited

U.S. PATENT DOCUMENTS

| | | | |
|---|---|---|---|
| 2,603,388 | 7/1952 | Bryant | 222/303 |
| 3,048,448 | 8/1962 | Aller | 302/52 |
| 3,194,420 | 7/1965 | Kemp et al. | 214/83.28 |
| 3,397,654 | 8/1968 | Snyder | 105/305 |
| 3,482,741 | 12/1969 | Fritz | 222/554 |
| 3,701,460 | 10/1972 | Dugge et al. | 222/193 |
| 3,778,114 | 12/1973 | Carney, Jr. et al. | 302/52 |
| 4,114,785 | 9/1978 | Dugge | 222/545 |
| 4,151,935 | 5/1979 | Dugge | 222/556 |
| 4,382,725 | 5/1983 | Dugge | 406/131 |
| 4,411,560 | 10/1983 | McComb | 406/128 |
| 4,695,207 | 9/1987 | Miller | 406/130 |
| 4,793,523 | 12/1988 | Bailey et al. | 222/288 |
| 5,000,358 | 3/1991 | Dugge | 222/502 |
| 5,131,722 | 7/1992 | DeCap | 222/502 |
| 5,236,287 | 8/1993 | Dugge et al. | 406/145 |
| 5,238,333 | 8/1993 | Dugge et al. | 406/145 |
| 5,353,713 | 10/1994 | Dohr et al. | 105/310 |
| 5,448,955 | 9/1995 | Dugge et al. | 105/305 |

*Primary Examiner*—Joseph A. Kaufman
*Attorney, Agent, or Firm*—Polster, Lieder Woodruff & Lucchesi, LC

[57] ABSTRACT

An outlet (10) for unloading a pulverulent lading comprises an outlet body secured to the lower reaches of a railcar in communication with the lading carried by the railcar. The outlet body has an opening therein through which the lading is unloaded. A valve mechanism (30, 32) is movable between a closed and an open position for lading discharge. A valve operator (56, 58) is used to open and close the valves. A sampling port (60) is formed in the valve mechanism. Movement of the valve from its closed position to a sampling position intermediate its closed and open positions, allows a small amount of lading to be discharged only from the sampling port so a sample of the lading may be readily taken. At this time, the valve member blocks the remainder of the outlet so a lading discharge tube (26) cannot be overfilled with lading, and no spillage of lading onto a right of way can occur.

8 Claims, 3 Drawing Sheets

OUTLET WITH SAMPLING PORT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to an outlet conventionally used on railcars for unloading a pulverant lading from within the car by gravity, a pneumatic conveying system, or the like. More specifically, this invention relates to readily taking a sample of the lading from the outlet without having to draw a large sample and in such a manner that the outlet may be readily and reliably closed after the sample is taken.

Conventionally, railcars, usually covered hopper cars, carry a variety of dry pulverant ladings. The lading may be powders such as cement or talc, or granular ladings such as grain or plastic pellets, or other dry, flowable pulverulent ladings. The covered hopper car is provided with hoppers that allow the lading to flow downwardly by gravity within the car toward one or more outlets at the bottom of the car. With some ladings, such as grain, the lading may be readily unloaded from the car merely by opening a slide gate at the bottom of the hopper and allowing the grain to flow by gravity through an open outlet into a grain transport system intake located below the railcar. However, with other ladings, such as with cement or plastic pellets, the shipper usually does not have an unloading transport system built into his siding. Here, it is generally intended that the lading not only be unloaded from the car, but also conveyed to a use or storage site some distance from where the railcar is unloaded. In these instances, it is typical for the lading to be unloaded using a so-called pneumatic unloading outlet.

Generally, a pneumatic unloading outlet includes an unloader body adapted to be secured to the bottom reaches of the downwardly sloping hopper sheets of a covered hopper car or the like. The outlet body has side sheets converging downwardly and inwardly to define an elongate discharge opening which typically extends laterally (from side-to-side) of the railcar. A product tube is positioned below the opening and is open to the discharge outlet to receive lading discharged through the opening. Typically, the outlet includes a valve selectively operable by a train attendant to regulate flow of lading from the discharge outlet into the product tube. One end of the product tube is open to the atmosphere and the other end is connected, via a hose, to a vacuum source which draws air into the open end of the product tube and through the product tube. As the air moves through the product tube, lading discharged into the product tube is entrained with the air and conveyed with the air to a storage receptacle or bin remote from the car.

A variety of railcar outlet types are known. For example, for direct gravity discharge of a lading, such as grain, a slide gate, such as is shown in U.S. Pat. No. 3,397,654, is often used. Such slide gates are relatively large plates that close off the product discharge opening in the discharge hopper and which are forcibly moved between a closed position and an open position by a gate opening and closing mechanism such as a rack and pinion drive.

Various designs for pneumatic outlets are known. A first type of pneumatic outlet uses a so-called rotating tube valve member (actually a tube with one side cut away) which is disposed within a product discharge slot of the outlet. The tube is rotatable about an axis parallel to the elongate discharge opening between a closed position (in which the cylindrical surface of the valve member blocks the flow of the lading) and an open position (in which the edge of the cut away section of the valve member rotates clear of the edge of the discharge opening and permits lading discharge into the product discharge opening). Such rotating tube pneumatic outlets are described in the co-assigned U.S. Pat. No. 3,778,114. As shown in this patent, an outlet typically has two (2) independently operable valve members, one disposed in a first half of the discharge opening and one disposed in the other half thereof. The outlet is provided with a set of two operating handles on each side of the outlet which may be operated by a train attendant to unload a lading from the railcar via the outlet. A first set of handles operates the valve member on the near side of the outlet and the other set operates the valve member on the far side of the outlet. Also as shown in this patent, a series of enlarged, spaced teeth is provided along one marginal edge of the valve member with indentations between the teeth controlling the discharge of the lading. A similar valve member construction is shown in co-assigned U.S. Pat. No. 3,194,420.

Another style of pneumatic outlet is shown in co-assigned U.S. Pat. No. 4,114,785 in which the near and far side valve members are rotary flapper gates mounted for rotation about an axis disposed generally parallel to the elongate discharge opening within and above the discharge opening for movement between a closed and an open position.

Still another style of pneumatic outlet is described in U.S. Pat. No. 4,411,560 in which a so-called rotating bar control valve is used. In a rotating bar outlet, the valve member is an enlarged diameter bar disposed within the discharge opening of the outlet for rotation about an axis parallel to, and somewhat below, the axis of the opening. With the bar valve in it closed position, the outer periphery of the bar spans across the outlet opening to block flow of lading from the discharge outlet. The valve is rotated from its closed position to bring elongated recesses in the valve member into communication with lading above the discharge outlet, and with a product discharge tube, so at least part of the lading is free to flow through the discharge outlet into the product tube.

Other pneumatic outlets are known which use horizontal slide gates movable by a mechanical operating mechanism between their closed and open positions to respectively block the flow and to permit the flow of lading from the discharge outlet into a product tube therebelow. Such slide gates described are in U.S. Pat. Nos. 4,695,207 and 5,000,358.

It is often desirable for a train attendant to take a sample of the lading in the railcar prior to unloading the lading. This can be accomplished by opening one of the hatches in the roof of the car and withdrawing a sample. However, this practice is discouraged because, first, it requires the attendant to climb onto the roof of the car and, secondly, by opening the hatch, there is a chance of contaminating the lading.

Train attendants have also taken lading samples by removing at least one of the end caps installed on the ends of the product discharge tube of a pneumatic outlet, and then operating the valve operating handles to partially open one of the valve members. This allows some of the lading to discharge from the outlet into the product discharge tube. Of course, once a small quantity of the lading has been so discharged, it is necessary for the attendant to close the valve to prevent continued flow of the lading into the product discharge tube. With certain types of pneumatic outlets, the train attendant must remove both the near and far side end caps, because these end caps are designed to prevent operations of either of the operating handles when either end cap is installed. Further, once a valve member is partially opened to withdraw the sample, it is often difficult to fully re-close the valve member. If the valve member does not fully close, lading continues to be discharged from the discharge opening of the outlet and this may result in the product tube becoming filled with lading. Of course, if the product tube becomes filled with the lading, air cannot be drawn through the product tube, thus preventing pneumatic conveying of lading from the railcar.

In an effort to overcome the problems of withdrawing a sample of lading from the outlet of a railcar, special sampling features have been incorporated into the outlets. As described in co-assigned U.S. Pat. No. 4,151,935, an arrangement was provided in a rotary flapper valve pneumatic outlet so the rotary valve member on the near side of the outlet may be moved from its fully closed position to a sampling or partially open position thereby allowing a sample of the lading to fall into the product tube. Because the end cap on the far side of the outlet need not be removed to permit the near side operating handle to be moved to the sampling position, the near valve member side could not be moved to its fully open position thus preventing the inadvertent full opening of the near side outlet valve. While this did facilitate sampling of lading via the outlet, movement of the near side outlet valve to the sampling position did release lading along the full length of the near side outlet valve (a length of approximately 31 inches) into the product discharge tube. Depending on the lading, its release, even in the partially open sampling position, may result in filling of the product discharge tube. Also, the quantity of lading released into the product discharge tube is often significantly greater than is required for a sample. The quantity of lading thus remaining in the product discharge tube now must be cleaned out. Often, it is discharged onto the railroad right of way beneath the railcar. If a toxic or hazardous lading was being sampled, the result was an environmental hazardous product spill. Still further, with such prior sampling outlets, because the entire near side outlet valve was moved to the partially open sampling position, some ladings (particularly large granular ladings) may become jammed between the edge of the outlet defining the product discharge opening and the valve member. This makes it difficult or impossible to fully re-close the outlet valve. If the outlet valve is not fully closed after taking a sample, subsequent shipping of the lading in the railcar may result in leakage of lading into the product tube so when it is desired to unload the lading, the product discharge tube would be filled with lading, thus preventing pneumatic unloading until the product discharge tube was cleaned out.

Accordingly, there has been a long-standing need for a sampling system usable with all types of outlets, which does not require opening the full length of the outlet valve to take a sample, which does not release unduly large quantities of the lading, and which does not become jammed with the lading so a valve member can be fully re-closed after a sample has been taken.

BRIEF SUMMARY OF THE INVENTION

Among the several objects and features of the present invention may be noted the provision of a sampling system for a variety of railcar outlets (e.g., slide gate, rotating tube, rotating bar, or rotary flapper valve outlets) in which only a portion of an outlet valve member is selectively opened to withdraw a lading sample.

The provision of such a sampling system in which the outlet valve is readily and reliably re-closed after a lading sample is drawn.

The provision of such a sampling system which lessens the chances of environmental contamination of a railroad right of way otherwise caused by drawing excess lading for a sample.

The provision of such a sampling system requiring only breakage of the seal on the near side of the outlet and in which the end cap on the far side of the outlet remains in place, the seal being put in place after a car is filled with lading to providing an indication to a train attendant that there has been no unauthorized opening of the outlet.

The provision of such a sampling system which lessens the chances of overfilling a product discharge tube with lading while drawing a sample.

The provision of such a sampling system which is of rugged and economical construction, which is reliable in operation, which works with a wide variety of ladings, and which does not require special training for use by train attendants.

Briefly stated, an outlet for unloading a pulverulent lading from a railcar or the like including a sampling system of the present invention comprises an outlet body adapted to be secured to the lower reaches of the railcar in communication with the lading carried by the car. The outlet body has an opening therein through which the lading is unloaded. A valve mechanism provided in the opening is movable between a closed position in which lading cannot be discharged from the opening, and an open position in which lading is discharged from the opening. A valve operator is provided for opening and closing the valve. A sampling means of the invention comprises a sampling port in the valve mechanism whereupon movement of the valve from its closed position to a sampling position intermediate its closed and open positions, a small amount of lading is discharged only from the sampling port so a sample of the lading may be readily taken.

A method of sampling a pulverulent lading from a railcar outlet or the like is also disclosed. The outlet has an opening through which the lading is discharged from the railcar. A valve mechanism is provided which is co-operable with the outlet for movement between an open position for discharging lading from the railcar and a closed position for retaining the lading within the railcar. A valve operator controls valve movement between its open and closed positions. The method of the invention comprises the steps of operating the valve to move the valve from its closed position to a sampling position intermediate its closed and its open positions. This positions a sampling port in the valve for communication only through the sampling port and facilitate discharge of lading therethrough while still blocking flow of the lading through the remainder of the outlet opening.

Other objects of this invention will be in part apparent and in part pointed out hereinafter.

BRIEF DESCRIPTION OF THE SEVERAL VIEWS OF THE DRAWINGS

Corresponding reference characters indicate corresponding parts throughout the several views of the drawings.

DETAILED DESCRIPTION OF THE INVENTION

Figure 1:
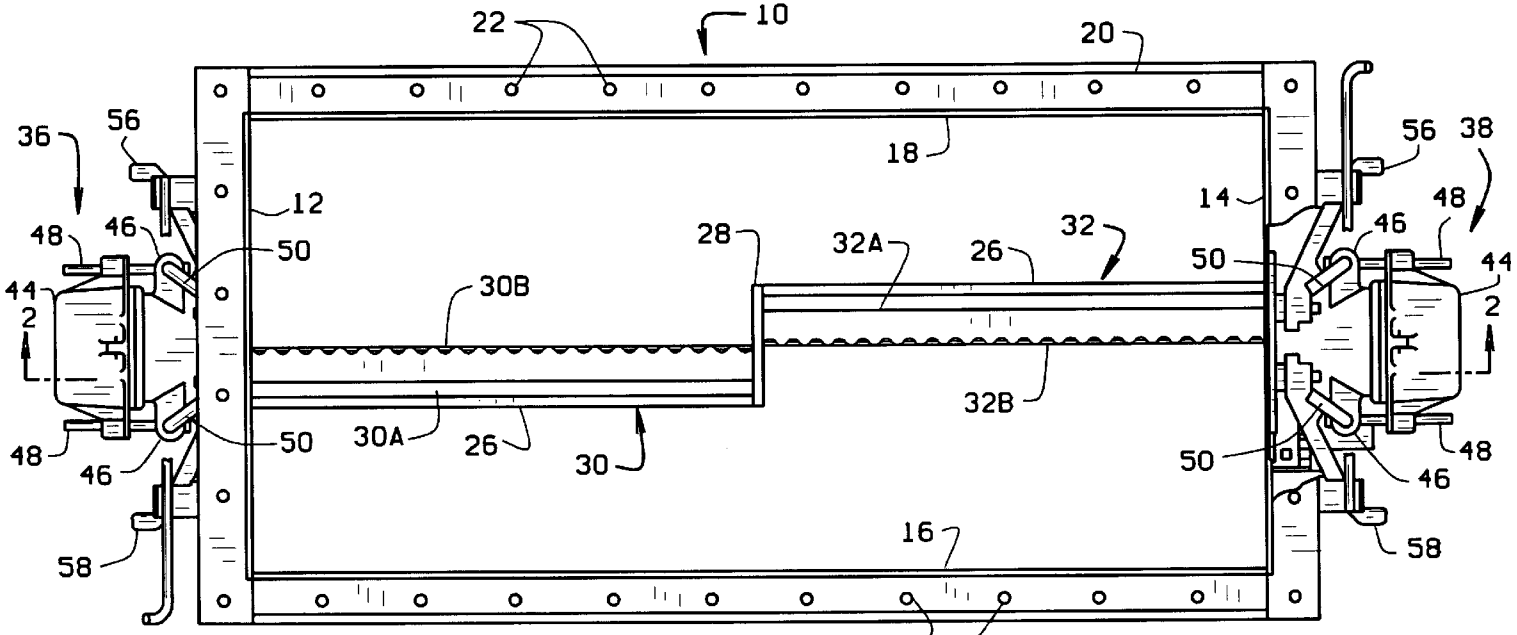
FIG. 1 is a top plan view of a pneumatic outlet for installation on the lower end of a hopper of a cover hopper railcar (not shown) for the pneumatic unloading of a pulverulent lading from the railcar.
Figure 2:
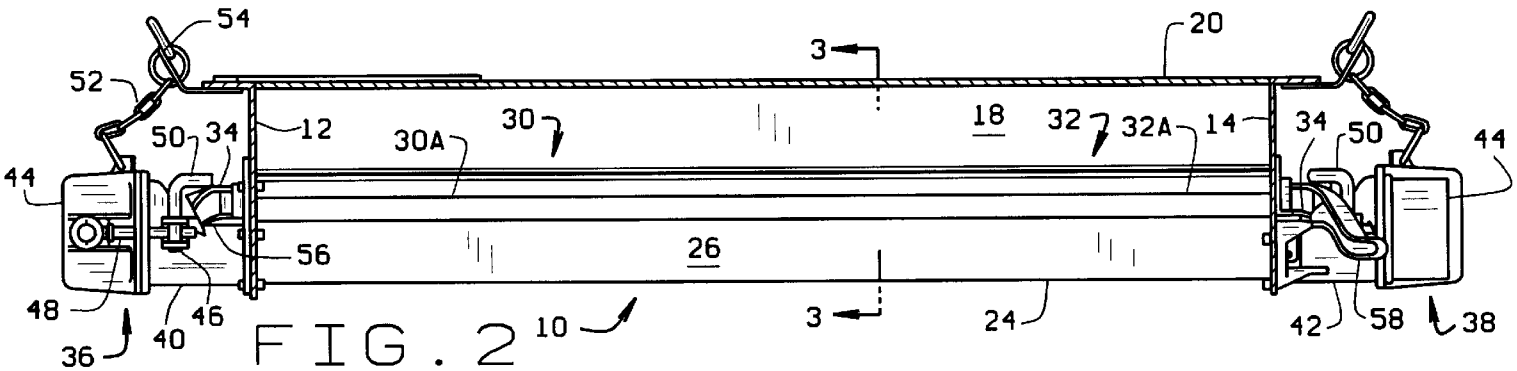
FIG. 2 is a vertical cross sectional view of the pneumatic outlet shown in FIG. 1 taken along line 2—2 of FIG. 1.
Figure 3:
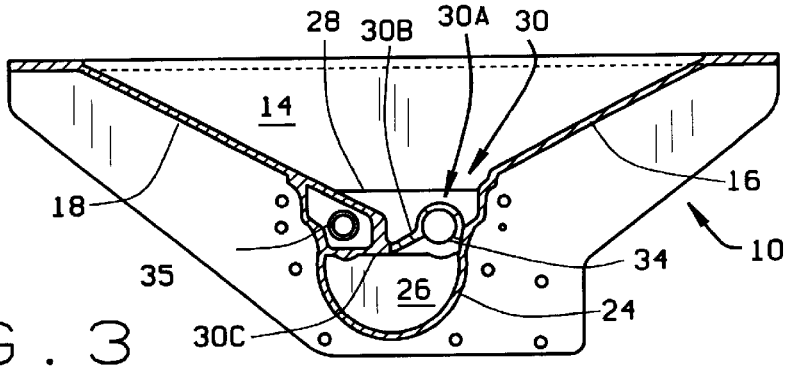
FIG. 3 is a vertical cross sectional view of the pneumatic outlet shown in FIG. 1 taken along line 3—3 of FIG. 2.

Referring to the drawings, a pneumatic outlet for discharging a pulverulent lading from a railcar is indicated generally 10 in FIGS. 1–3. The general construction of outlet 10 is described, for example, in co-assigned U.S. Pat. Nos. 4,114,785, 5,236,287 and 5,238,333, the teachings of which are incorporated herein by reference. Briefly, outlet 10 is shown in FIG. 1 to be rectangular in plan and to have respective end sheets 12, 14, and downwardly and inwardly sloping side sheets 16, 18. A rectangular flange 20 formed at the upper end of the outlet has a plurality of spaced openings 22 for mounting the outlet on the underside of a railcar beneath a lading discharge opening formed by the bottom reaches of downwardly sloping side sheets of the railcar.

A bottom cover 24 extends the length of the outlet and a lading discharge tube 26 of the outlet is constructed in two section from cover 24 in accordance with the teachings of the above referenced patents. A bulkhead or divider 28 separates the respective sections with the product discharge tube 26 extending through the divider. Respective outlet valves 30, 32 are installed in cover 24. Each valve includes a longitudinally extending, rotatable valve shaft 30A, 32A having an integrally formed, outwardly projecting valve member 30B, 32B. Each valve shaft 30A, 32A has an inwardly extending bore formed in each end. Respective mounting shafts 34, 35 (see FIG. 3) each have one end received in one of the recesses formed by these bores. The shafts 34 are stub shafts. One end of each stub shaft 34 fits in the recess formed in the outer end of the respective valve shafts 30A, 32A, and the other end extends through an opening in the respective side sheets 12, 14 adjacent the valve (see FIG. 2). The shafts 35 are longer shafts one end of each of which fits in the recess formed in the inner end of each valve shaft. Each shaft 35 is received in, and extends through an opening formed in divider 28 (see FIG. 3), and to and through an opening formed in the side sheet on the opposite side of the outlet from where the valve is mounted.

End closures 36, 38 attach to respective end sheets 12, 14 for connecting lading discharge apparatus (not shown) to the outlet for discharge of lading. A horizontally extending end adapter or discharge tube extension 40, 42 respectively, extends outwardly from the end sheets 12, 14, with the inner end of each end adapter being in lading flow communication with a respective end of discharge tube 26, and the outer end of each end adapter being capped by a removable end cap 44. Each end adapter 40, 42 has opposed ears 46 extending from the sides of the tube and rotatable locking rods 48 are received in notches in these ears. The rods are rotatable by handles 50. As shown in FIG. 2, the end caps 44 are attached by a chain 52 to a bracket 54 to keep the caps from being misplaced when they are removed from the end of their respective discharge tube extension 40, 42. With the caps removed, hoses (not shown) of the discharge apparatus are attached to the outer end of the discharge tubes 40, 42. A pneumatic conveying system (not shown) is coupled to the hoses so as to drawn air through the open end of product discharge tube 26 at the opposite side of the railcar and through the product discharge tube into the hoses. Lading discharged from the outlet valves 30, 32 falls down into the product discharge tube 26 where it is entrained in the air moving therethrough so as to be pneumatically conveyed from the outlet. Valve control handles 56, 58 allow the unloading operator to control both outlet valves 30, 32. One handle 56 is connected to shaft 34 for the adjacent valve 30, 32, and the other handle 58 is connected to shaft 35 for operating the other valve. By turning each valve control handle (each of which is operable independently of the other), the operator can control the opening and closing of both valves from the same side of the railcar. It will be appreciated that the construction and operation of the valve control handles may be as described in the co-assigned U.S. Pat. No. 4,151,935 which is herein incorporated by reference.

Figure 4:
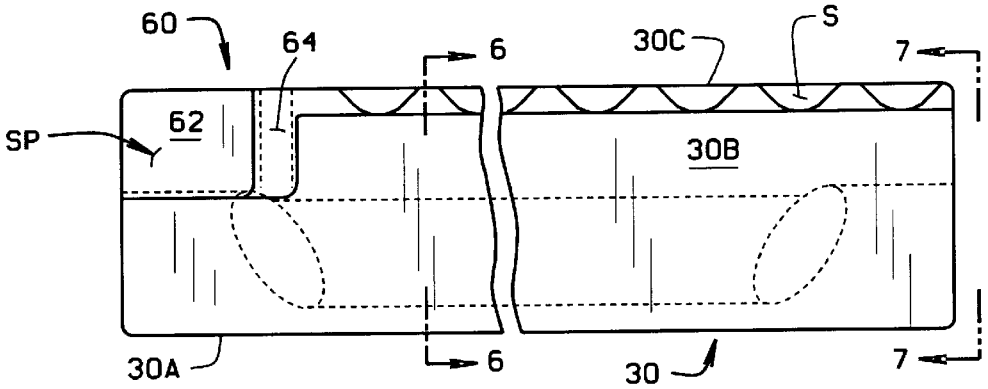
FIG. 4 is a top plan view of an outlet valve member of the pneumatic outlet shown in FIGS. 1–3 illustrating a sampling port or slot formed in one end of the valve member.
Figure 5:
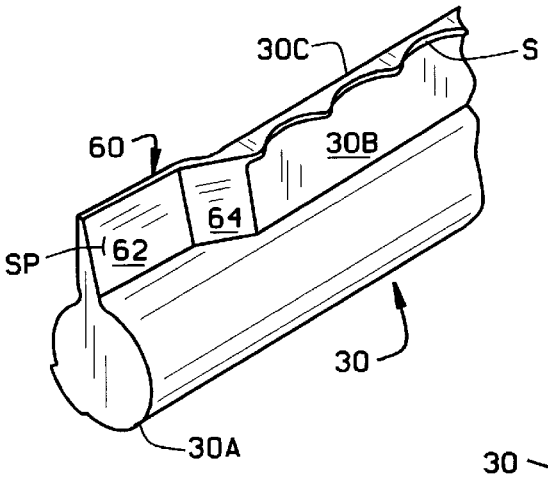
FIG. 5 is a perspective view of a portion of the outlet valve member shown in FIG. 4 illustrating the sampling port or slot formed in the one end of the valve member.
Figure 6:
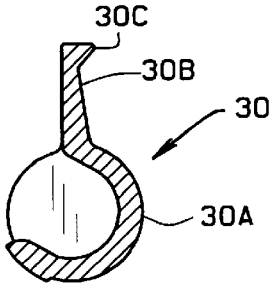
FIG. 6 is a cross sectional view of the valve member taken along line 6—6 of FIG. 4.
Figure 7:
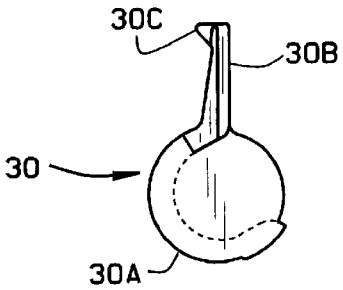
FIG. 7 is an end view of the valve member taken along line 7—7 of FIG. 4.

Referring to FIGS. 4–7, valve 30 incorporating the sampling port of this invention is shown in more detail. It will be understood that that valve 32 is similarly constructed and thus need not be described in detail. As shown, valve member 30B comprises an elongate generally rectangular (in plan, as shown in FIG. 4) valve member which extends radially outwardly from valve shaft 30A (see FIGS. 5–7). The valve member has a flapper portion extending radially from valve shaft 30A and this flapper uniformly tapers from shaft 30A to the outer end of the valve member. A flange 30C is formed at the outer end of the valve member, orthogonally to the valve member. The flange extends generally the length of the valve members and has a series of uniformly spaced scallops S formed in it as shown in FIG. 5.

In accordance with the invention, a sampling means 60 comprises a sampling port SP formed in either or both valve 30, 32, at the end of the valve adjacent the side of the outlet. Sampling port SP is formed by modifying the end of the valve member adjacent the end of the valve. A plate section 62 is formed at the at the end of the valve, the thickness of the plate also tapering outwardly from valve shaft 30A to the outer end of the plate. However, the thickness of the plate throughout its length is significantly reduced from that of the valve member. In addition, a sloping surface or joggle 64 is formed between the end of the valve member adjacent the sampling port and plate 62. This surface provides for a smooth, rather than an abrupt, transition between the valve member and the sampling port. While the actual length of the sampling port SP may vary from one type of valve member construction to another, the length of the sampling port is preferred to be less than about ½ of the length of the valve member. Even more preferably, the sampling port should extend about less than about 1/10 of the length of the valve member. As shown in FIG. 4, the length of valve member 30B may be slightly less than about 32 inches and the length of sample port SP is about 2.47 inches from the end of the valve member to the innermost region of the joggle 64.

To obtain a sample, the attendant breaks a seal on the one side of the outlet and removes the end cap 44 at that side of the outlet. The seal and end cap on the other side of the outlet remain in place. The attendant then operates the valve control handle 56 to rotate shaft 34 and the adjacent valve 30 or 32 to a sampling position which is intermediate the closed and open positions of the valve. He does not need to move the other valve at all to obtain a sample. As he turns the valve open to the sampling position, sampling port SP is opened, but the remainder of the valve remains closed. This allows only a small amount of lading to fall through the sampling port into lading discharge tube 26. This small amount of material is sufficient for sampling purposes and is deposited in the product discharge tube 26 proximate the open end thereof where it may be readily removed by the attendant for analysis. The attendant then operates handle 56 to move shaft 34 in the opposite direction to re-close the valve. The end cap can then be replaced. By partially rotating valve 30 or 32 from its fully closed position, the sampling port SP for lading discharges only through the sampling port, such that a sample amount of lading is facilitated, but flow of lading through the remainder of the outlet opening is blocked. This eliminates the possibility of overfilling lading discharge tube 26 with lading while drawing a sample. When the lading is to be fully discharged through the outlet and the respective valves are fully opened, the presence of the sampling port has no effect on the normal discharge of lading through the opened valves. Because the amount of the sample is small, there is less likelihood of excess lading being spilled upon the sample being drawn.

Referring to FIGS. 8A–8B, 9A–9B, and 10A–10B, it will be understood that the sampling system and method of the present invention are applicable to other outlet constructions beside the rotary flapper valve pneumatic outlet described above. For example, in FIGS. 8A and 8B, an outlet 110 is shown as being partially defined by end sheet 112 and side sheets 116, 118. The outlet includes a tubular valve member 130 which is rotatable about an axis parallel to and below the discharge opening of the outlet. Such a rotary tube outlet is described in detail in the co-assigned U.S. Pat. No. 3,778,114 which is herein incorporated by reference. In accordance with this invention, a sampling port 160 comprising a slot 162 is formed in the outer end of the valve member. Operation of the valve member is similar to that previously described in which a train attendant rotates the valve member to a sampling position intermediate the closed and open positions of the valve. This exposes slot 162, but only the slot. A sample of lading falls through the slot into a discharge tube 140 where it is retrieved by the attendant. After the sample is taken, the valve member is returned to its fully closed position.

Figure 9A:
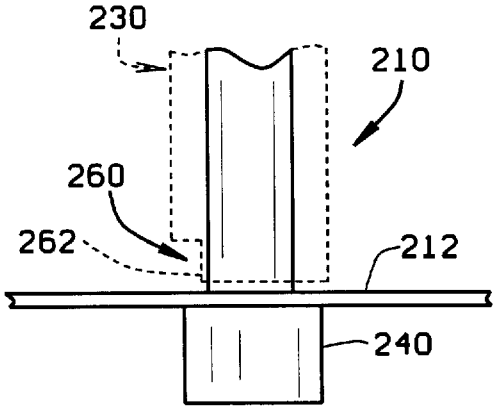
FIGS. 9A and 9B illustrate an outlet having a slide gate valve member showing a sampling port or slot of the present invention incorporated in one end of the slide gate valve member.
Figure 9B:
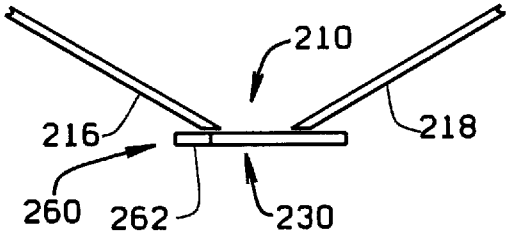
Figure 8A:
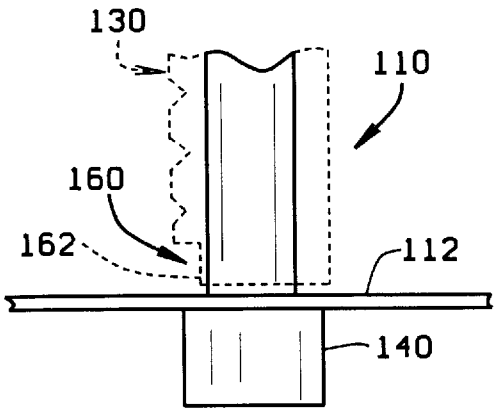
FIGS. 8A and 8B illustrate an outlet having a tubular valve member rotatable about an axis parallel to and below the discharge opening of the outlet illustrating a sampling port or slot of the present invention incorporated in one end of the valve member.
Figure 8B:
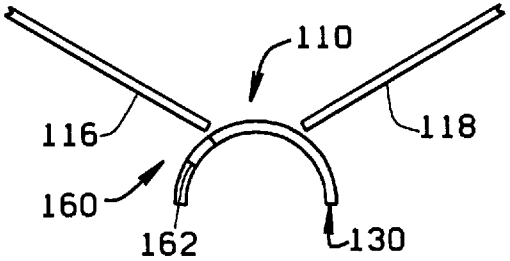

In FIGS. 9A and 9B, an outlet 210 is shown as being partially defined by end sheet 212 and side sheets 216, 218. The outlet has a slide gate valve member 230 including a sampling port 260 comprising a notch 262 incorporated in one end of the slide gate valve member. Such a slide gate outlet without the sampling port of the present invention is illustrated in co-assigned U.S. Pat. Nos. 5,000,358 and 5,448,955 which are herein incorporated by reference. Now, the train attendant operates a mechanism to slide the outlet gate in the direction indicated by the arrow to move the gate to a sampling position intermediate the closed and open positions of the valve. Again, this exposes only the sampling port or notch 262, but not the remainder of the gate blocks the flow of the lading from the discharge outlet opening. A sample of lading falls through the notch into a discharge tube 240 and is collected by the attendant. After the sample is taken, the gate is moved in the opposite direction back to its fully closed position.

Figure 10A:
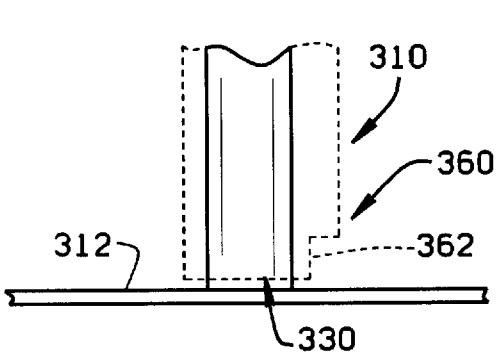
FIGS. 10A and 10B illustrate an outlet having a rotating bar valve member with a sampling port or slot of the present invention incorporated in one end of the rotating bar valve member.
Figure 10B:
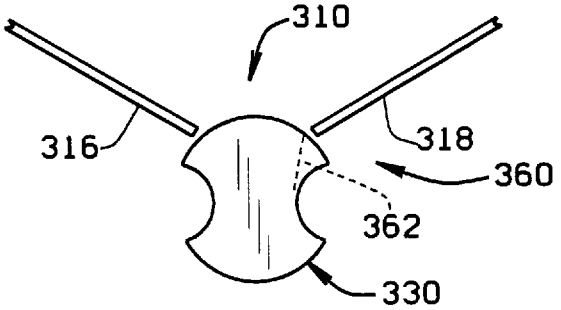

In FIGS. 10A and 10B, an outlet 310 having a rotating bar valve member 330, is partially defined by end sheet 312 and side sheets 316, 318. The valve member includes a sampling port 360 formed by a slot 362 in one end of the rotating bar valve member. By rotating the bar valve member in the appropriate direction to a sampling position between the valve's closed and open position, a lading sample can be taken as before.

As with the sampling system associated with outlet 10, in each of these latter three instances, positioning the sampling port in the valve in registry with the opening permits fluid communication only through the sampling port and facilitates discharge of a sample amount of lading. But, flow of lading through the remainder of the outlet opening is always blocked. Again, this eliminates the possibility of overfilling a lading discharge tube with lading while drawing the sample And, again, when lading is to be fully discharged through the outlet and the respective tubular valve member, sliding gate valve member, or rotatable bar valve member is fully opened, the presence of the sampling port has no effect on the normal discharge of lading through the opened valve.

What has been described is sampling system usable for a variety of railcar or other outlets wherein only a portion of an outlet valve member is selectively opened to withdraw a lading sample. The valve is readily and reliably re-closed after a lading sample is drawn, and the possibility of environmental contamination caused by drawing excess of lading for a sample is greatly reduced because the chance of overfilling a product discharge tube with lading while drawing a sample is substantially eliminated. Using the sampling system requires breaking only the seal and removing an end cap on one side of the outlet with the and end cap on the opposite side of the outlet remaining in place. The sampling system used on any of the various types of outlets described is of a rugged and economical construction, is reliable in operation, is usable with a wide variety of ladings, and does not require special training for use by train attendants.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

We claim:

1. In an outlet for unloading a pulverant lading from a railcar, said outlet having an outlet body adapted to be secured to the lower reaches of said railcar in communication with said lading, said outlet body having an opening therein through which said lading can be unloaded, said opening being an elongate opening and extending transversely of said railcar, a valve positioned in said opening and extending substantially the length of said opening, said valve being movable between a closed position in which said lading remains within said railcar and an open position in which said lading can be discharged from said opening, and an operating handle for operating said valve, wherein said improvement comprises: a sampling port in said valve, said sampling port extending less than about one half the length of said valve such that upon movement of said valve from its closed position to a sampling position intermediate said open and closed positions, a small amount of said lading is discharged only from said sampling port such that a sample of said lading can be readily taken, said sampling port cooperating with said opening to allow said lading sample to be discharged from said sampling port while the remainder of said opening remain blocked by said value.

2. In an outlet as set forth in claim 1 wherein said sampling port in said valve extends less than about 1/10 of the length of said valve.

3. In an outlet as set forth in claim 1 wherein said valve means is rotatable about an axis parallel to said elongate opening for movement between its open and closed positions, and wherein said sampling port is provided in a portion of said valve such that upon rotation of said valve from its closed position to said sampling position, said sampling port is moved into registry with said opening thereby to permit the discharge of said lading sample through said sampling port while the remainder of said valve cooperates with said outlet so as to block the flow of lading from said opening except through said sampling port.

4. In an outlet as set forth in claim 1 wherein said valve is a slide gate translatable relative to said opening between said open and closed positions, said sampling port comprising a notch in an edge of said slide gate such that upon translation of said gate relative to said outlet opening from said closed to said sampling position, said notch is in registry with said opening thereby to permit the discharge of said lading sample from said notch while the remainder of said gate blocks the flow of said lading from said opening.

5. In an outlet as set forth in claim 4 wherein said opening is an elongate opening extending transversely of said railcar, wherein said valve extends substantially the length of said opening, and wherein said notch extends less than about ½ of the length of said valve such that with said valve in its sampling position, said notch cooperates with said opening to allow said lading sample to be discharged from said notch while the remainder of said opening remains blocked by said valve means.

6. In an outlet as set forth in claim 3 or 5 wherein said valve comprises a near side valve member and a far side valve member with said near and far side valve members being operable independently of one another and with at least one of said valve members having said sampling port therein.

7. A method of sampling a pulverant lading from an outlet of a railcar, said outlet having an opening through which said lading may be discharged from the railcar, a sliding gate valve translatable relative to said opening movable between an open position for the discharge of said lading from said railcar and a closed position for retaining said lading within said railcar, a sampling port comprising a notch in one edge of said sliding gate valve, means for operating the said valve for movement between its open and closed positions, wherein the method comprises the steps of:

operating said valve operating means so as to translate said sliding gate valve from its closed position to a sampling position intermediate its said closed and open positions in which said sampling notch in said valve opens communication through said opening so as to discharge said lading only through said sampling notch while blocking the flow of said lading through the remainder of said opening thereby to enable a sample of said lading to be taken.

8. A method of sampling a pulverant lading from an outlet of a railcar, said outlet having an opening through which said lading can be discharged from the railcar, a rotatable bar valve having a sampling port formed by a slot adjacent one end of said rotatable bar, said bar valve being rotatable relative to said opening between a closed position in which said bar valve blocks the flow of lading from said opening and an open position in which said lading can be discharged from said opening, means for rotating the said valve for movement between its open and closed positions, wherein the method comprises the steps of:

operating said valve operating means so as to rotate said rotatable bar valve from its closed position to a sampling position intermediate its said closed and open positions in which a sampling port in said valve opens communication through said opening so as to discharge said lading only through said sampling port while blocking the flow of said lading through the remainder of said opening.

* * * * *

UNITED STATES PATENT AND TRADEMARK OFFICE

CERTIFICATE OF CORRECTION

PATENT NO : 5,868,284

DATED : February 9, 1999

INVENTOR(S) : Macchling et al.

It is certified that error appears in the above-identified patent and that said Letters Patent are hereby corrected as shown below:

Col. 1, Lines 14 and 21
Replace "pulverant" with -- pulverulent

Col. 2, Line 38
Replace "it" with -- its

Col. 8, Claim 1, Line 60
Replace "pulverant" with -- pulverulent

Column 10, Claims 7 and 8, Lines 7 and 26
Replace "pulverant" with -- pulverulent Signed and Sealed this Eighth Day of May, 2001

*Attest:*

Nicholas P. Godici

NICHOLAS P. GODICI

*Attesting Officer*

*Acting Director of the United States Patent and Trademark Office*